50-458
6/9/87 OR 4,671,063

United States Patent [19]

Anaker

[11] Patent Number: 4,671,063

[45] Date of Patent: Jun. 9, 1987

[54] HYDRAULIC INTENSIFIER

[75] Inventor: Donald G. Anaker, Rockford, Ill.

[73] Assignee: Midwestern Reliable Equipment, Inc., Rockford, Ill.

[21] Appl. No.: 738,859

[22] Filed: May 29, 1985

[51] Int. Cl.[4] ..... F15B 15/18

[52] U.S. Cl. ..... 60/458; 60/477; 60/485; 60/486

[58] Field of Search ..... 60/485, 486, 477, 458, 60/456

[56] References Cited

U.S. PATENT DOCUMENTS

| | | | |
|---|---|---|---|
| 2,668,417 | 2/1954 | Gleasman | 60/456 |
| 3,681,919 | 8/1972 | Forster | 60/458 |
| 3,952,516 | 4/1976 | Lapp | 60/477 |
| 4,240,255 | 12/1980 | Benilan | 60/458 |
| 4,366,673 | 1/1983 | Lapp | 60/477 |

*Primary Examiner*—Albert W. Davis, Jr.
*Attorney, Agent, or Firm*—Leydig, Voit & Mayer

[57] ABSTRACT

A hydraulic intensifier having a hydraulic motor driven from a low pressure source and operable to drive a low pressure pump for sucking oil from a reservoir and for delivering the oil as charge oil to a high pressure pump. The latter also is driven by the hydraulic motor and pressurizes the charge oil so as to deliver oil at high pressure to a hydraulic actuator. The intensifier is of a self-contained and modular construction and includes a case which defines the oil reservoir and which is closed by detachable end caps permitting the motor and the low pressure pump to be pulled out of one end of the case and permitting the high pressure pump to be pulled out of the other end of the case.

5 Claims, 3 Drawing Figures

HYDRAULIC INTENSIFIER

BACKGROUND OF THE INVENTION

This invention relates to a hydraulic pressure intensifier which receives pressure fluid from a low pressure source and increases the pressure of the fluid before delivering the fluid to a utilization device.

Lapp U.S. Pat. No. 3,952,516 discloses one type of hydraulic intensifier. In the Lapp intensifier, a hydraulic motor is driven by low pressure oil from a supply source and drives a high pressure pump which boosts the pressure of the oil and delivers the oil to the utilization device. The low pressure oil exhausted from the utilization device is returned to the supply source.

The present intensifier preferably is of the self-contained type in which a hydraulic motor drives a low pressure pump as well as a high pressure pump. The motors and pumps are encased within a housing which serves as an oil sump. The low pressure pump draws oil from the sump and delivers such oil at low pressure to the high pressure pump to charge the latter. The high pressure pump boosts the pressure of the oil and delivers the oil to the utilization device. Oil exhausted from the utilization device is returned to the sump for recirculation to the low pressure pump. In this way, the oil circulates in a closed loop between the intensifier and the utilization device and thus the circuit is not contaminated by foreign material in the low pressure fluid from the supply source.

SUMMARY OF THE INVENTION

The general aim of the present invention is to provide a new and improved hydraulic intensifier —preferably of the self-contained type—which is light in weight, compact in size, and simple in construction and which, at the same time, may be more easily repaired or rebuilt than prior intensifiers of the same general type.

Another object of the invention is to provide a hydraulic intensifier which is modular in construction so as to enable the high pressure pump to be easily pulled out of one end of the intensifier for repair or replacement and so as to enable the hydraulic motor and/or the low pressure pump to be easily pulled out of the other end of the intensifier.

The invention also resides in the novel arrangement of the oil delivery tube connecting the two pumps and in the novel arrangement of the drive shaft connecting the motor to the pumps so as to enable the pumps and the motor to be pulled from the ends of the intensifier without interference from the delivery tube or drive shaft.

These and other objects and advantages of the invention will become more apparent from the following detailed description when taken in conjunction with the accompanying drawings.

DETAILED DESCRIPTION OF THE PREFERRED EMBODIMENT

Figure 1:
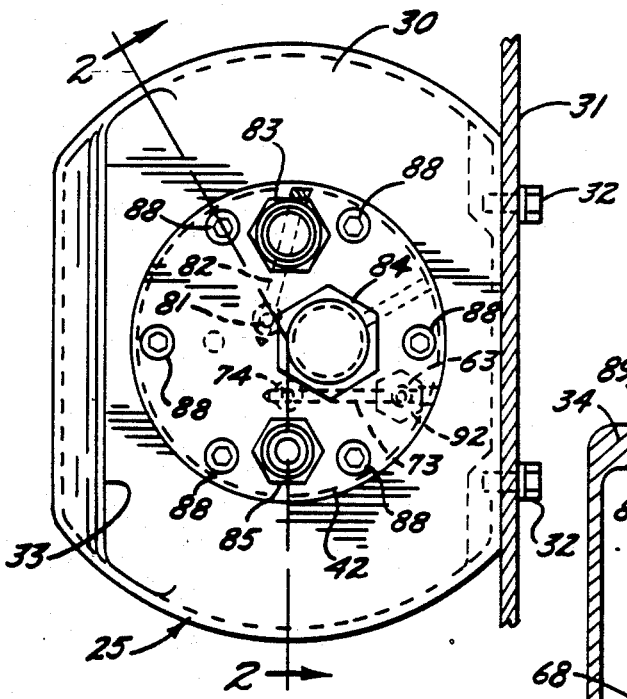
FIG. 1 is a top plan view of a new and improved hydraulic intensifier incorporating the unique features of the present invention.
Figure 3:
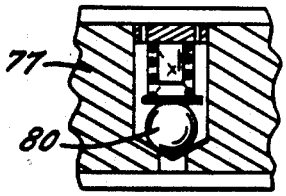
FIG. 3 is an enlarged cross-sectional view of certain parts shown in FIG. 2.

The invention is shown in the drawings in conjunction with a hydraulic system in which a low pressure pump 10 delivers pressure fluid 11 from a low pressure source such as a reservoir 12 to a hydraulic pressure intensifier 13. The latter, in turn, delivers oil at high pressure to a utilization device 14. Herein, the utilization device is shown as being a reciprocating double-acting hydraulic actuator having a cylinder 15 which slidably receives a piston 16 and a rod 17. Advancement of the rod is effected when oil at high pressure is admitted into the head end of the cylinder and when low pressure oil is exhausted from the rod end of the cylinder. The rod is retracted when high pressure oil is admitted into the rod end of the cylinder and when low pressure oil is exhausted from the head end of the cylinder. It will be appreciated, however, that the actuator 14 may be of the single-acting type in which a spring (not shown) effects retraction of the rod when oil is exhausted from the head end of the cylinder.

The pump 10 is connected to the intensifier 13 by a flexible line 20 while a flexible line 21 extends from the intensifier to return pressure fluid 11 to the low pressure supply or reservoir 12. Flexible lines 22 and 23 extend from the intensifier to the head and rod ends, respectively, of the hydraulic actuator 14. The lines 22 and 23 may be connected to a four-way valve (not shown) for controlling the flow of oil between the intensifier and the actuator.

A typical application of the hydraulic actuator 14 is for operating a cutting or crimping tool which is maneuvered by a worker standing in a bucket of a utility truck boom adapted to be operated by the pump 10. The latter is driven by the power take-off system of the truck and, in one particular example, is capable of delivering pressure fluid at a rate of about 10 gpm. and at a maximum presure of about 3,000 psi. In most instances, however, it may be necessary to supply oil to the actuator 14 at a pressure of between 10,000 and 12,000 psi. The intensifier 13, therefore, may be connected between the pump 10 and the actuator 14 to deliver oil to the actuator at the required high pressure. The intensifier may be carried in the boom bucket and may be connected to the pump 10 by plain hoses 20 and 21 rather than high pressure wire braid hoses since only low pressure fluid 11 is delivered to the intensifier. As a result, there is no danger of the connecting hoses 20 and 21 presenting an electrical hazard by acting as a ground if the operator should happen to contact high voltage wires.

The present intensifier 13 includes a housing 25 which preferably defines a reservoir or sump 24 for oil that is to be delivered to the actuator 14. The housing contains a hydraulic motor 26 which drives a high pressure pump 27 and which preferably also drives a low pressure pump 28. In general, the hydraulic motor 26 is driven by low pressure fluid 11 supplied to the intensifier 13 from the reservoir 12 by the pump 10, the low pressure fluid exhausted from the motor being returned to the reservoir via the line 21. The hydraulic motor drives both pumps with the low pressure pump 28 serving to suck oil from the sump 24 and to deliver such oil to the high pressure pump 27. The latter boosts the pressure of the charge oil to a high value and delivers oil at high pressure to the actuator 14. Oil, exhausted from the actuator is returned to the sump 24 for recirculation by the pumps 28 and 27. As a result, the oil which is supplied to the actuator circulates in a closed circuit which is separate from the circuit of the low pressure fluid 11 from the reservoir 12. Accordingly, the oil delivered to the actuator retains good dielectric properties and is not contaminated with foreign material that might be in the low pressure fluid 11.

In accordance with the primary aspect of the present invention, the intensifier 13 is modular in structure so that the motor 26 and the pumps 27 and 28 may be easily removed from the housing 25 for repair or replacement. As a result of the modular construction, it is not necessary to tear down the entire intensifier to repair or replace any particular part and, in addition, the intensifier may be manufactured with motors and pumps of various types and capacities.

Figure 2:
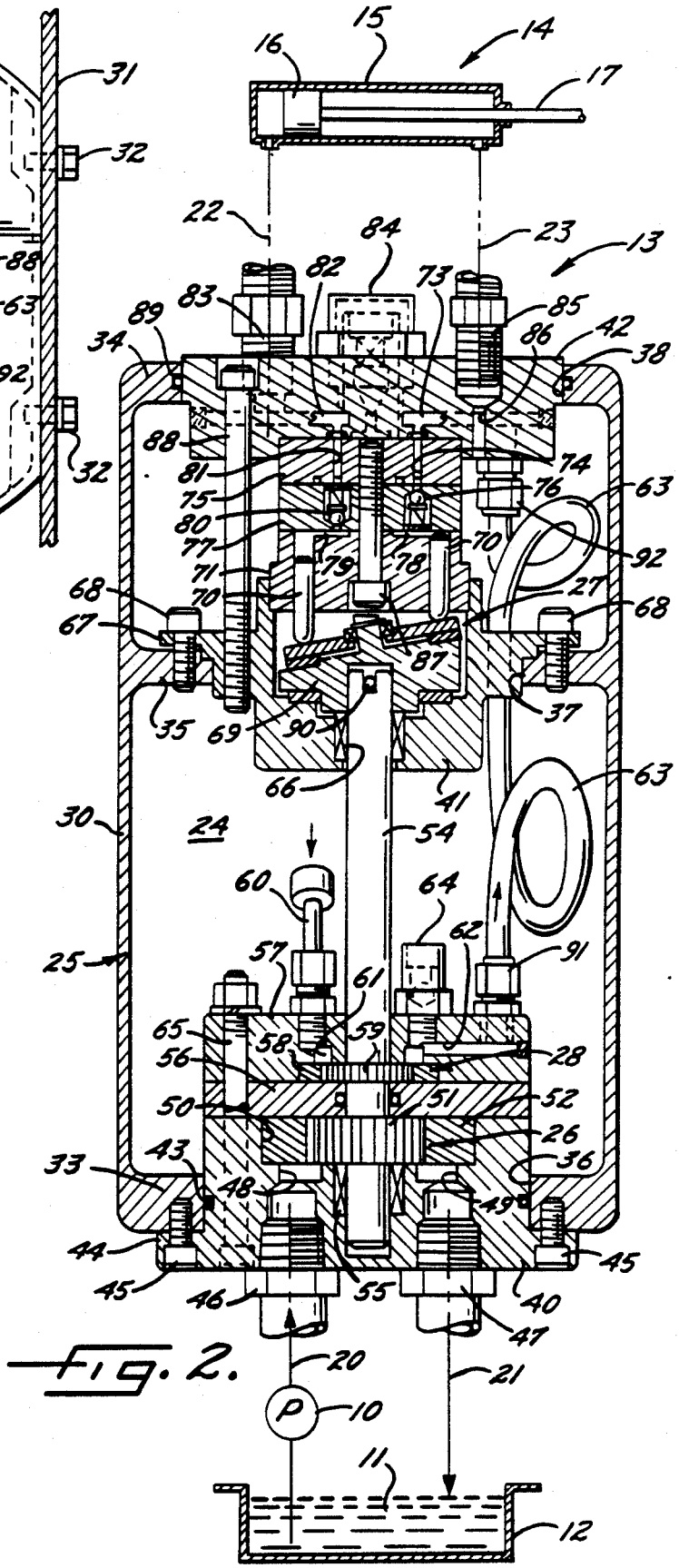
FIG. 2 is a cross-section taken substantially along the line 2—2 of FIG. 1 and schematically shows the intensifier connected to a typical low pressure source and to a typical utilization device.

More specifically, the present housing 25 is defined by an elongated shell or case 30 having two diametrically opposite arcuate sides and having two diametrically opposite flat sides (see FIG. 1). One of the flat sides of the case 30 may be attached to a mounting plate 31 by screws 32. A lifting handle 33 projects upwardly from the other flat side of the case and may be used to carry the intensifier 13. The intensifier may be operated either with the housing disposed in an upright position as shown in FIG. 2 or may be operated while located horizontally and resting on the mounting plate 31. The sump 24 defined within the housing holds about two quarts of oil and, when the sump is filled, the intensifier weighs about 16 pounds. In the present instance, the vertical dimension of the intensifier is about 10", the dimension across the two arcuate sides of the case 30 is about 6½" and the dimension across the two flat sides of the case is about 5½". Thus, the overall intensifier is relatively light in weight and is relatively compact in size.

As shown in FIG. 2, an annular end wall 33 is formed at the lower end of the case 30 while an annular end wall 34 of slightly narrower radial width is formed at the upper end of the case. In addition, an intermediate annular wall or partition 35 is formed within the case somewhat above the vertical midpoint thereof and divides the sump 24 into upper and lower compartments. Openings 36, 37 and 38 are formed through the walls 33, 34 and 35, respectively.

In keeping with the invention, caps 40, 41 and 42 are disposed in the openings 36, 37 and 38, respectively, are detachably connected to the case 30, and serve to support the motor 26 and the pumps 27 and 28. By detaching the cap 40 from the end wall 33, the motor 26 and the pump 28 may be pulled out of the case 30 through the lower opening 36. By detaching the caps 41 and 42, the pump 27 may be pulled out of the case through the upper opening 38. Thus, easy access can be gained to the various parts for purposes of repairing or replacing the parts.

More particularly, the lower end cap 40 is telescoped into the opening 36 and is sealed therein by an 0-ring 43. A radially extending peripheral flange 44 on the lower end of the cap 40 abuts the lower end of the end wall 33 and is secured detachably to the end wall by screws 45.

Fittings 46 and 47 are attached to the lines 20 and 21, respectively, are threaded into the lower end cap 40, and communicate with passages 48 and 49 in the end cap. The latter is formed with a cavity 50 which defines a housing for the hydraulic motor 26. In the present instance, the motor is of the gerotor-type and includes an outer ring 51 and an inner rotor 52. Low pressure fluid 11 supplied to the motor via the passage 48 drives the rotor 51 and is exhausted from the motor by way of the passage 49.

The rotor 51 of the motor 26 is coupled to a vertical drive shaft 54 whose lower end portion is journaled for rotation by a bearin9 55 in the end cap 40. The shaft projects upwardly from the rotor through a seal plate 56 and extends to the low pressure pump 28. Herein, the pump 28 also is of the gerotor-type having a cap 57 which houses a ring 58 and a rotor 59. When the rotor 59 is driven by the shaft 54, oil from the sump 24 is sucked into the pump through an inlet line 60 and an inlet passage 61 and is discharged from the pump by way of a delivery passage 62 and a delivery line 63. A relief valve 64 is threaded into the pump cap 57 and unloads if the discharge pressure exceeds a predetermined magnitude. The pump cap 57 and the seal plate 56 are connected detachably to the end cap 40 by bolts 65 which extend through the end cap 40.

As shown in FIG. 2, the drive shaft 54 extends upwardly to the intermediate cap 41 and is journaled by a bearing 66 therein. The intermediate cap is telescoped into the opening 37 in the partition 35 and is formed with a radial flange 67 overlying the partition and secured detachably thereto by screws 68.

The end cap 41 serves as a housing for a swash plate 69 which forms part of the high pressure pump 27. The swash plate is connected to be rotated by the shaft 54 and is adapted to alternately reciprocate pistons 70 which are slidably supported by a piston block 71 telescoped into a counterbore in the upper end portion of the cap 41.

Low pressure oil supplied to the line 63 from the low pressure pump 28 flows through a passage 73 in the end cap 42, through passage means 74 in a distributing ring 75, past spring-loaded ball valves 76 in a valve block 77 and positively charges the low pressure passages 78 of the piston block 71. When the pistons 70 are reciprocated by the swash plate 69, the charge oil is pressurized in high pressure passages 79 in the piston block 71 and is forced past spring-loaded ball halves 80 in the valve block 77. The pressurized oil then flows through passage means 81 in the distributor ring 75, to a passage 82 in the end cap 42 and then is delivered to the actuator 14 by way of a fitting 83 threaded into the end cap 42. An unloading valve 84 is threaded into the end cap 42 and communicates with the passage 82 to relieve the pressure of the oil delivered to the actuator if that pressure exceeds a predetermined magnitude.

Oil returning from the actuator 14 flows into another fitting 85 threaded in the end cap 42 and is returned to the sump 24 by way of a hole 86 in the end cap 42. There is fluid communication between the upper and lower compartments of the sump 24 through the partition 35 and the cap 41 and thus oil returning into the upper compartment via the hole 86 may flow into the lower compartment for recirculation by the pump 28.

The valve block 77 and the distributor ring 76 are clamped to the piston block 71 by a screw 87. The upper end portion of the distributor ring is telescoped into a cavity in the lower end portion of the upper end cap 42 and is clamped tightly thereto. For this purpose, the upper end cap 42 is telescoped into the opening 38 in the end wall 34 and is secured tightly to the intermediate cap 41 by screws 88 extending between the two caps. When the screws are tightened, the end cap is drawn downwardly to clamp against the distributor ring 75 and to clamp the piston block 71 tightly against the intermediate cap 41. An 0-ring 89 seals the upper end cap 42 within the opening 38 in the end wall 34.

Removal of the motor 26 and the pump 28 from the case 30 may be effected quickly and easily simply by removing the screws 45 and pulling the end cap 40 downwardly to pull the motor and the pump downwardly through the opening 36. As the motor is moved downwardly, the drive shaft 54 automatically disconnects from the swash plate 69 by virtue of the provision of a pin-and-slot coupling 90 between the swash plate and the upper end of the shaft. In addition, the delivery tube 63 is made of flexible material (e.g., plastic) and is sufficiently long to provide enough slack for the pump cap 57 to be pulled downwardly out of the case 30. Once the pump cap 57 is out of the case, a fitting 91 on the lower end of the tube may be loosened to disconnect the tube from the pump cap and to free the entire lower assembly.

The high pressure pump 27 may be pulled out of the upper end of the case 30 for repair or replacement by first removing the screws 88. Thereafter, the end cap 42 may be pulled upwardly out of the opening 38 in the end wall 34, the slack in the flexible delivery tube 63 permitting the cap to be pulled upwardly sufficiently far to enable a fitting 92 on the upper end of the tube to be disconnected from the end cap. Once the end cap 42 has been removed, there is free access to the distributor ring 75, the valve block 77 and the piston block 71 and thus either block may be replaced as a unit when wear occurs. In addition, the pin-and-slot coupling 90 permits the swash plate 69 to be pulled upwardly off of the shaft 54 and out of the opening 38. Finally, the screws 67 may be removed to permit the intermediate cap 41 to be pulled upwardly out of the opening 38 for purposes of replacing either the cap 41 or the bearing 66 thereof.

Thus, it will be apparent that the modular construction of the present intensifier 13 enables the motor 26 and the pumps 27 and 28 to be easily removed from and replaced in the case 30. Motors and pumps of different types and/or capacities may be employed by using caps having different internal configurations but having external configurations similar to the caps 40, 41 and 42 and compatible with the case.

What is claimed is:

1. A hydraulic intensifier operable to receive low pressure fluid from a supply source and operable to deliver high pressure oil to a hydraulic utilization device, said intensifier comprising a housing defining a closed sump for oil, said housing having first and second end walls with openings therein and having an intermediate wall with an opening therein and located between said end walls to divide said housing into first and second compartments, first, second and intermediate caps disposed in the openings in said first, second and intermediate walls, respectively, a hydraulic motor and a low pressure hydraulic pump supported by said first cap and disposed in said first compartment, a high pressure hydraulic pump supported by said second and intermediate caps and disposed in said second compartment, a shaft connecting said motor to said pumps and operable to drive said pumps when said motor is driven by low pressure fluid received by said intensifier from said supply source, said low pressure pump being operable when driven by said shaft to suck sump oil from said housing and to deliver such oil to said high pressure pump to charge the latter pump, said high pressure pump being operable when driven by said shaft to increase the pressure of the oil received from said low pressure pump and to deliver such oil at high pressure to said utilization device, means releasably connecting said first cap to said housing and detachable to permit said motor and said low pressure pump to be withdrawn from said first compartment through the opening in said first end wall, means releasably connecting said second and intermediate caps to said housing and detachable to permit said intermediate cap and said high pressure pump to be withdrawn from said second compartment through the opening in said second end wall, and means releasably connecting said shaft to one of said pumps and automatically releasing said shaft from such pump as an incident to either of said pumps being withdrawn from said housing.

2. A hydraulic intensifier as defined in claim 1 further including a tube extending between said pumps for delivering oil from said low pressure pump to said high pressure pump, said tube being flexible and having sufficient lengthwise slack between said pumps to permit said first and second caps to be pulled away from said first and second walls when said caps are detached from said housing.

3. A hydraulic intensifier as defined in claim 2 in which said means releasably connecting said shaft to said one pump comprise a pin-and-slot connection between said one pump and the adjacet end of said shaft.

4. A hydraulic intensifier as defined in claim 2 further including bearings in said first cap and said intermediate cap and rotatably supporting said shaft.

5. A hydraulic intensifier operable to receive low pressure fluid from a supply source and to deliver high pressure oil to a utilization device, said intensifier comprising a housing defining a closed sump for oil, said housing having first and second end walls with openings therein and having an intermediate wall locted between said end walls to divide said housing into first and second compartments, first and second end caps disposed in the openings in said first and second end walls, respectively, a hydraulic motor and a low pressure hydraulic pump supported by said first end cap and disposed in said first compartment, a high pressure hydraulic pump supported by said second end cap and said intermediate wall and disposed in said second compartment, a shaft connecting said motor to said pumps and operable to drive said pumps when said motor is driven by low pressure fluid received by said intensifier from said supply source, said low pressure pump being operable when driven by said shaft to suck sump oil from said housing and to deliver such oil to said high pressure pump to change the latter pump, said high pressure pump being operable when driven by said shaft to increase the pressure of the oil received from said low pressure pump and to deliver such oil at high pressure to said utilization device, means releasably connecting said first end cap to said housing and detachable to permit said motor to be withdrawn from said first compartment through the opening in said first end wall, means releasably connecting said second end cap to said housing and detachable to permit said high pressure pump to be withdrawn from said second compartment through the opening in said second end wall, and means releasably connecting said shaft to one of said motor and said high pressure pump and automatically releasing said shaft as an incident to either of said motor and said high pressure pump being withdrawn from said housing.

* * * * *